United States Patent [19]

Horn

[11] 3,986,159

[45] Oct. 12, 1976

[54] AIR DROPPED SONOBUOY

[75] Inventor: George M. Horn, San Diego, Calif.

[73] Assignee: The United States of America as represented by the Secretary of the Navy, Washington, D.C.

[22] Filed: Sept. 2, 1975

[21] Appl. No.: 609,267

[52] U.S. Cl. ..... 340/2; 340/8 S; 9/8 R

[51] Int. Cl.[2] ..... B63B 21/52

[58] Field of Search ..... 340/2, 8 S; 9/8 R

[56] References Cited

UNITED STATES PATENTS 3,444,511 5/1969 Morrow ..... 340/8 S 3,803,540 4/1974 Mar et al. ..... 340/2

*Primary Examiner*—Richard A. Farley

*Attorney, Agent, or Firm*—Richard S. Sciascia; Ervin F. Johnston; William T. Skeer

[57] ABSTRACT

An installation mechanism for an underwater flexible structure includes a plurality of pressure controlled pumps which distend a flexible underwater structure and provide fluid pressure to support such structure in an operative, distended position.

13 Claims, 8 Drawing Figures

AIR DROPPED SONOBUOY

STATEMENT OF GOVERMENT INTEREST

The invention described herein may be manufactured and used by or for the Government of the United States of America for governmental purposes without the payment of any royalties thereon or therefor.

FIELD OF THE INVENTION

This invention pertains to the field of marine engineering. More particularly, this invention pertains to the field of oceanographic instrument construction and design. In still greater particularity, this invention pertains to the structural design of oceanographic instrumentation stations. By way of further characterization, this invention pertains to construction of oceanographic, data gathering structures which are unmanned and remotely controlled for the gathering of oceanographic data. By way of further illustration, but without specific limitation thereto, this invention provides for a remotely operated, power distention package to erect and deploy a portable, oceanographic buoy structure.

DESCRIPTION OF THE PRIOR ART

Collection of oceanographic data requires, in most instances, the precise location of oceanographic sensors in a specified spatial arrangement with respect to each other. This is particularly true in the study of physical and chemical phenomena occurring within the sea. The collection of data indicative of these dynamic occurrences within the sea are useful in determining the propagation of underwater acoustic energy.

Sensors for this purpose are generally held in fixed spatial relationships with each other by underwater structures deriving positional and mechanical stability from the stiffness of the structural members or by a cable network that retains the original and predetermined spatial orientation. Such cable networks are usually dependent upon widely spaced buoys and anchors and require a considerable extend of space beneath the surface of the sea.

Although each of these technical approaches have been found to be successful for their intended purposes in the past, each requires many man hours and a lengthy deployment of ships for the installation of the sensor arrays.

SUMMARY OF THE INVENTION

This invention provides for the fixed spatial orientation of a plurality of oceanographic sensors or transducers by the use of flexible and fluid pressure distended structure located beneath the surface of the sea which derives its stiffness and spatial integrity by means of fluid pressure which distends flexible arms into a rigid configuration. A power package for this type of oceanographic structure is provided which, without manual activation or control, activates the structure by providing a source of fluid pressure to cause this distention. A plurality of pumps providing, respectively, a large volume of fluid at low pressure and a low volume of fluid at high pressure are united in such a way that structural rigidity is obtained with a minimum of space or power being utilized for this purpose. Further, a power connection between a source of electrical power and the respective pumps also provides for pressure equalization of the pumps. These features combine to provide an economical and efficient packaging in the deployment system.

STATEMENT OF THE OBJECTS OF INVENTION

It is an object of this invention to provide an improved support for an oceanographic instrumentation system.

A further object of this invention is the provision of a power unit to distend flexible structures in underwater environments with fluid pressure.

Yet another object of this invention is to provide an improved pump system for oceanographic applications.

Yet another object of this invention is the provision of an improved pump system useful in underwater structural systems.

A further object of this invention is to provide an improved oceanographic buoy pump system which is remotely actuated to maintain a constant fluid volume and pressure.

Yet another object of this invention is to provide an underwater pump system having pressure equalization structure formed integrally therewith.

Yet another object of this invention is to provide a marine pumping system of compact dimensions and modest power requirements.

These and other objects of the invention will become readily apparent from the ensuing description when taken together with the drawings.

DESCRIPTION OF THE PREFERRED EMBODIMENTS

Figure 1:
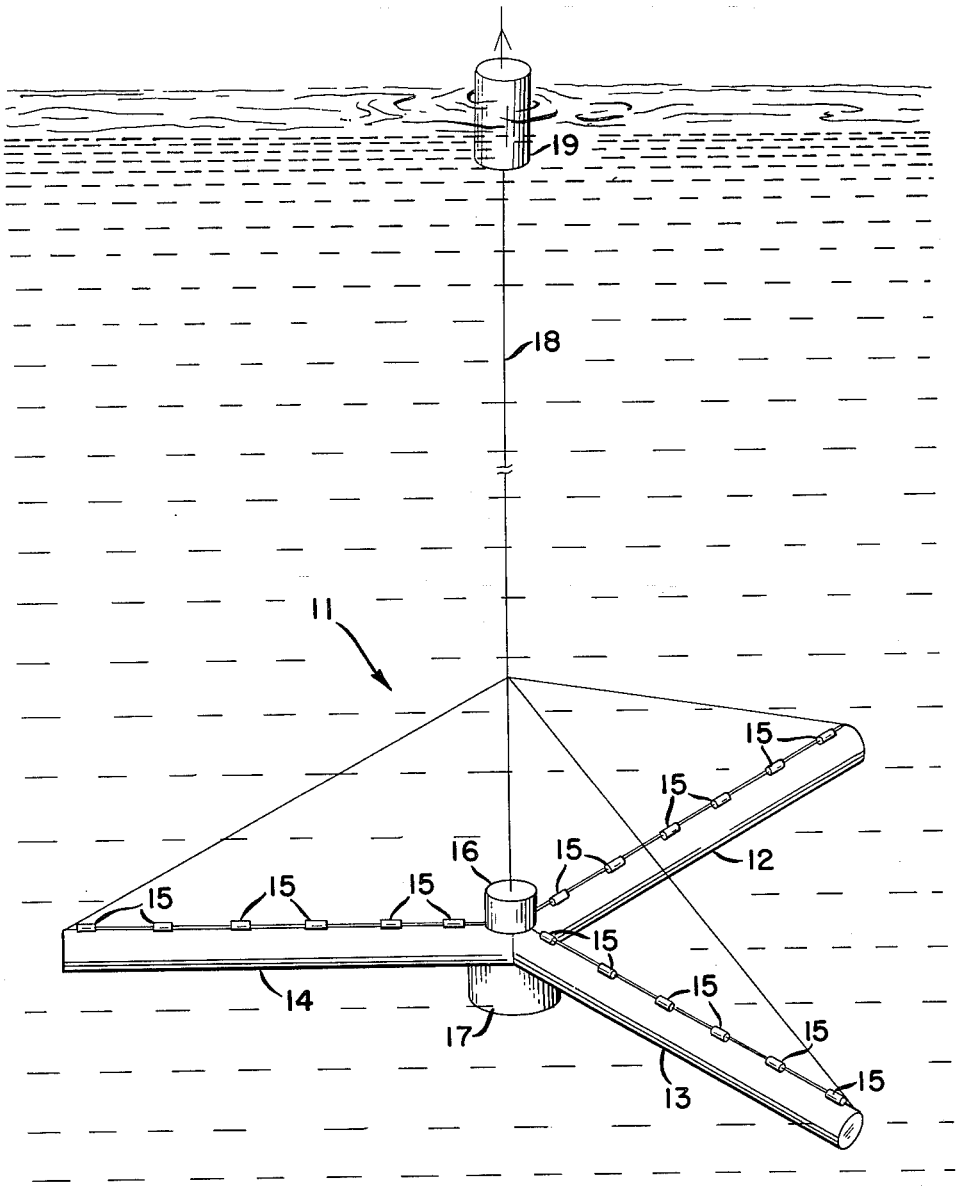
FIG. 1 is a perspective view of the system of the invention in an operational environment.

Referring to FIG. 1, an oceanographic transducer array 11 is illustrated in an operational environment. Array 11 comprises three radially divergent arms 12, 13, and 14. A plurality of oceanographic transducers 15 are mounted on the exterior of arms 12 and 13 and 14 and are electrically connected to suitable processing circuitry housed in electronic instrument package 16. The precise nature of transducers 15 and the electronic circuitry housed within instrument package 16 is immaterial insofar as the understanding of the invention is concerned. However, for purposes of completeness and illustration, transducers 15 may be considered to be electroacoustic hydrophones and the electronics within housing 16 may be signal amplifiers and processing circuitry.

A housing 17 connected to and depending from array 11 houses the pumping mechanism, to be more completely described herein, which provides structural rigidity for arms 12, 13, and 14. Electroacoustic array 11 is suspended from and electrically connected to a co-axial transmission line 18, which provides support from and electrical connection to a surface buoy 19. As will be more fully described herein, buoy 19 may contain conventional sonobuoy transmission equipment to provide a wireless data link to a remote point.

Figure 2:
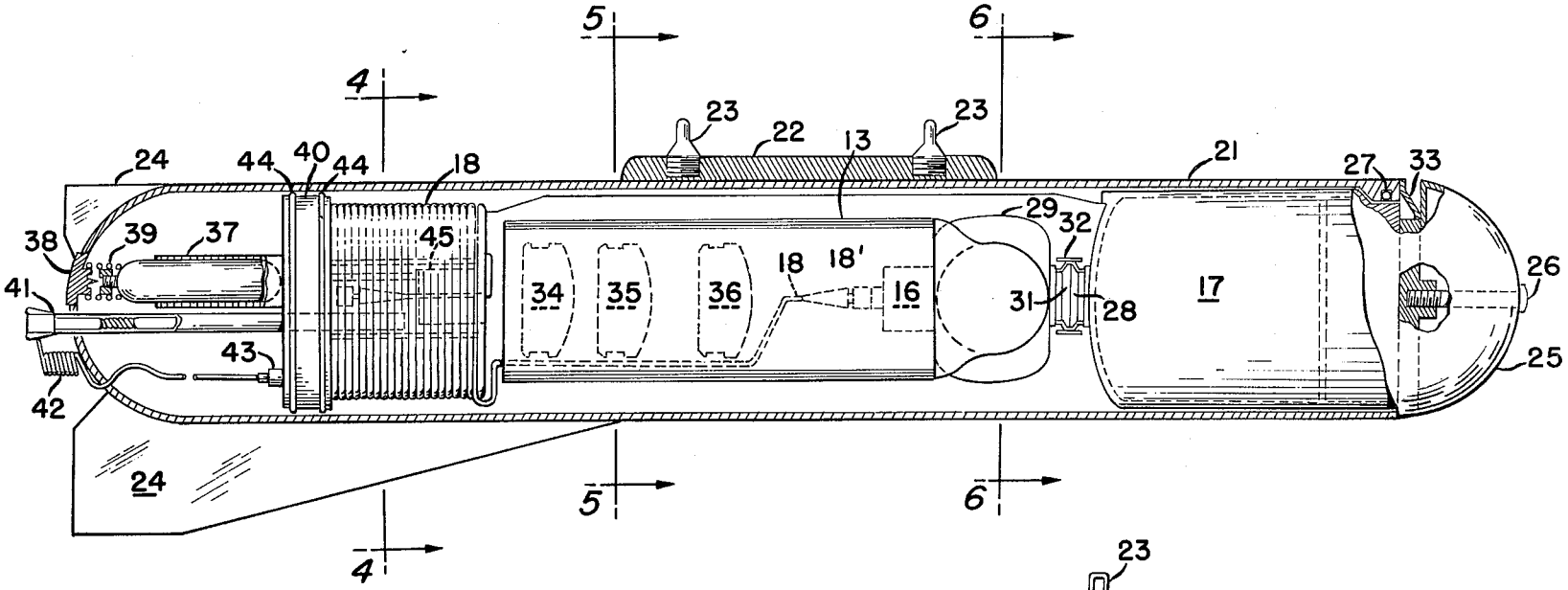
FIG. 2 is a partial sectional view of the system of FIG. 1 in a storage configuration.

Referring to FIG. 2, a sectional view of a system illustrated in FIG. 1 prior to deployment is illustrated. As shown, the system is contained within a cylindrical housing 21 which has a strongback 22 affixed thereto. Engagement eyes 23 extend, upwardly from strongback 22 to provide attachment points for the stored system such that housing 21 may be conveniently handled.

It should be noted that housing 21 is configured to facilitate aerial deployment by attaching eyes 23 to suitable exterior carriages on an aircraft such that the entire assembly may be released from overhead flying aircraft and will deploy upon impact with the water to the configuration illustrated in FIG. 1, described above.

Although this construction lends itself to deployment from aircraft, of course, the invention may also be deployed from surface ships. In such a deployment, shipboard cranes would place the entire package over the side by utilizing the attachment eyes 23 in the same fashion as if the system were to be dropped from an aircraft.

A plurality of fins 24 extend radially outward from the after portion of housing 21 and provide stabilization during the aerial drop and also serve to orient the package such that the forward end thereof comprising a hemispherical nose portion 25 impacts the water. Nose portion 25 may be weighted to provide additional stabilization in downward direction and is attached to cylindrical housing 21 by means of a central bolt 26. Bolt 26 passes through the forward portion of nose 25 and is threadably affixed to the lower portion of pump and battery housing 17.

Housing 17 and other elements of the system attached thereto are held within housing 21 by means of a spring retainer 27. Spring retainer 27 is held in an inwardly protruding detend which is utilized for stabilization and retention of other portions of the assembly to be more completely described. Housing 17 has an upstanding flange 28 which provides attachment to a metal plenum chamber 29 by cooperation with a similarly shaped fitting 31. Fittings 28 and 31 are held in fluid-tight engagement by means of a cooperating clamp 32 which encircles fittings 28 and 31 and forces them together by means of clamping pressure. Conduits 13, 14, and 15 are attached to plenum chamber 29 and folded within cylindrical housing 21 to provide a compact assembly with the end capping portions 34, 35 and 36 centrally held within the folds. This storage arrangement will become more apparent with reference to FIGS. 5 and 6 to be presently described.

As shown, housing 21 is free to slide forward against spherical nose portion 25 that is held in a rearward position by the biasing pressure afforded by spring 33. Spring 33 is an encircling disc-type spring and is inserted to urge cylindrical housing 31 and nose portion 25 apart to the degree permitted by spring retainer 27.

In the aft end of housing 21, a gas cylinder 37 is retained in a suitable open ended enclosure where it is biased into retaining position by means of a coil spring 39 which cooperates with a cap 38. Cap 38 is suitably received in the after portion of housing 21 by means of engaging threads or other mechanical means and permits withdrawal and insertion of a cartridge 37 prior to actual deployment. The inner surface of closure 38 has a puncturing projection which cooperates with cartridge 37 to rupture a frangible wall thereof, thereby permitting escape of the gas stored therein. Gas cylinder 31 is mounted atop a piston 40. Piston 40 is a portion of a reel or storage spool upon which the oceanographic cable or transmission line 18 is spirally wound.

Piston 40 also carries electronic transmitter 45 which is a conventional telemetry type transmitter. An antenna 41 is also carried on the aft end of housing 21 and extends inwardly such that movement of piston 40 actuates an internal mechanism which erects antenna 41 to an operative position. A variety of such telescoping antennas are known in the art and choice among these conventional structures is dependent upon conventional electronic parameters such as power, frequency and activation method. Antenna 41 is electrically connected to transmitter 45 via coaxial cable 42 which terminates in a conventional electronic fitting 43. Coaxial cable 42 may be coiled either internally or externally with respect to housing 21 to allow sufficient slack to permit piston 40 to move along the length of housing 41.

Upon activation of gas cylinder 37, the escape of the gas contained therein drives piston 40 in a downward direction. This downward movement is link connected to pump housing 17 and forces pump housing 17 out of engagement with housing 21 by overcoming the spring tension of spring retainer 27. Pump housing 17 exits the forward end of housing 21 carrying with it plenum chamber 29 and conduits 12, 13, and 14. Piston 40 is prevented from exiting housing 21 by means of spring retainer 27 such that the housing 21 remains fluid-tight at its forward end and, because of the gas filled volume from cylinder 37, acts as a buoy 19.

Figure 3:
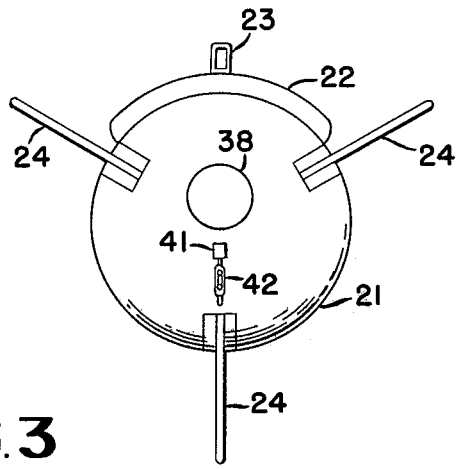
FIG. 3 is an end view of the system illustrated in FIG. 2.

Referring to FIG. 3, an end view of the housing prior to deployment is shown. As may be readily seen, mounting eyes 23 extend vertically above the uppermost portion of stabilizer fins 24 such as to permit housing 21 to be mounted on the lower surface of a planar structure such as an aircraft wing, for example. Closure 38 is illustrated as being a plane surface member. However, as will be obvious to those versed in the art, suitable engagement surfaces such as internal square or hexagon may be fashioned thereon so as to cooperate with conventional tools. Likewise, the relationship between antenna 41 and coaxial cable 42 is more clearly illustrated in FIG. 3 and shows how cable 42 might be wound to minimize aerial resistance should housing 21 be dropped a considerable distance through the atmosphere.

Figure 4:
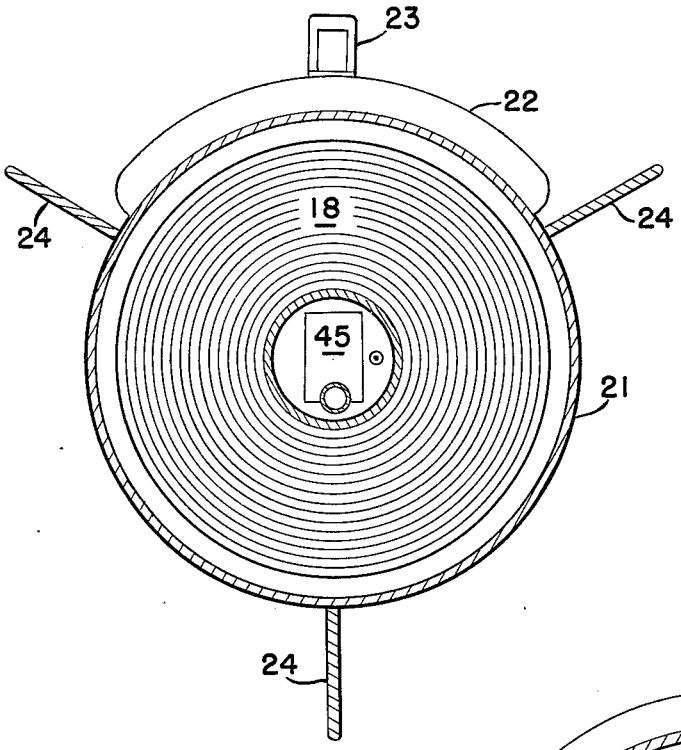
FIGS. 4, 5, and 6 are sectional views taken along lines 4—4, 5—5, and 6—6 of FIG. 2.

Referring to FIG. 4, a sectional view taken along lines 4—4 of FIG. 2, the location of transmitter 45 within the hub of the reel containing cable 18 is better illustrated. In the arrangement shown, transmitter 45 is carried to the forward or lower, end of housing 21 by the activation of gas cylinder 37, which moves piston 40. The circumferential extent of strong back 22 is illustrated as being approximately 90°. Of course, the relative dimensions of strongback 22 may be varied to suit the particular application by following good design practice in the marine engineering arts.

Figure 5:
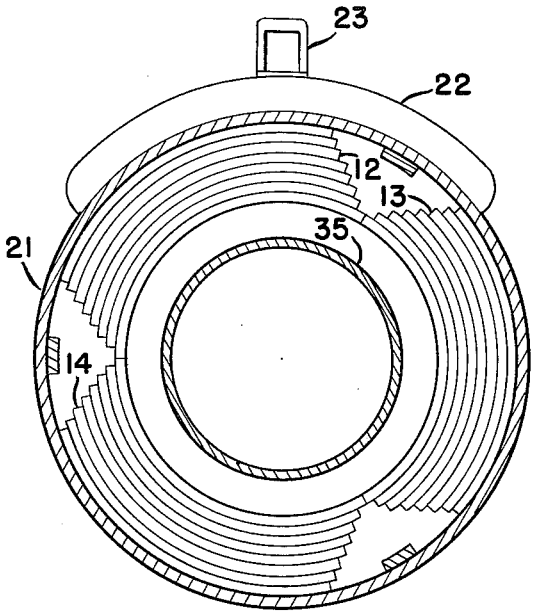

Referring to FIG. 5, a sectional view taken along lines 5—5 of FIG. 2, the stored position of conduits 12, 13, and 14 is illustrated. As shown, conduits 12, 13, and 14 are stored in a collapsed position and folded longitudinally of housing 21 to provide three equiangularly spaced stacks of conduit material. A solid end cap 35 is shown in a central location. End cap 35, along with end caps 34 and 36 provide a solid terminal end for each of the conduits 12, 13, and 14, respectively. In the stored position, the end caps provide a central core upon which the conduits may be conveniently stored and, upon distention, assist the filling of the conduits and prevention of twisting and blockage thereof. The triangular spaces between conduits 12, 13, and 14 provide longitudinal passage for connecting links joining piston 40 to housing 17.

Figure 6:
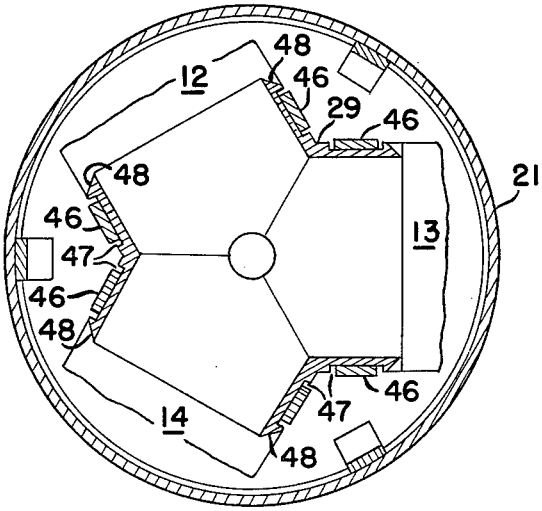

Referring to FIG. 6, a sectional view taken along lines 6—6 of FIG. 2, the method of attachment of conduits 12, 13, and 14 to plenum chamber 29 is illustrated. As is shown, plenum chamber 21 has three equiangular conduit sections extending radially from a central point. Each of these conduit sections has a circumferential groove 47 extending thereabout and a pointed nose 48. Nose 48 is extended into the bitter end of conduits 12, 13, and 14, respectively and the clamp 46 is placed about an assembled conduit and plenum chamber and tightened until it is received within groove 47.

The method of attachment of conduits 12, 13, and 14 in plenum chamber 39 is the same as that used to attach conduits 12, 13, and 14 to end segments 34, 35, and 36.

Figure 7:
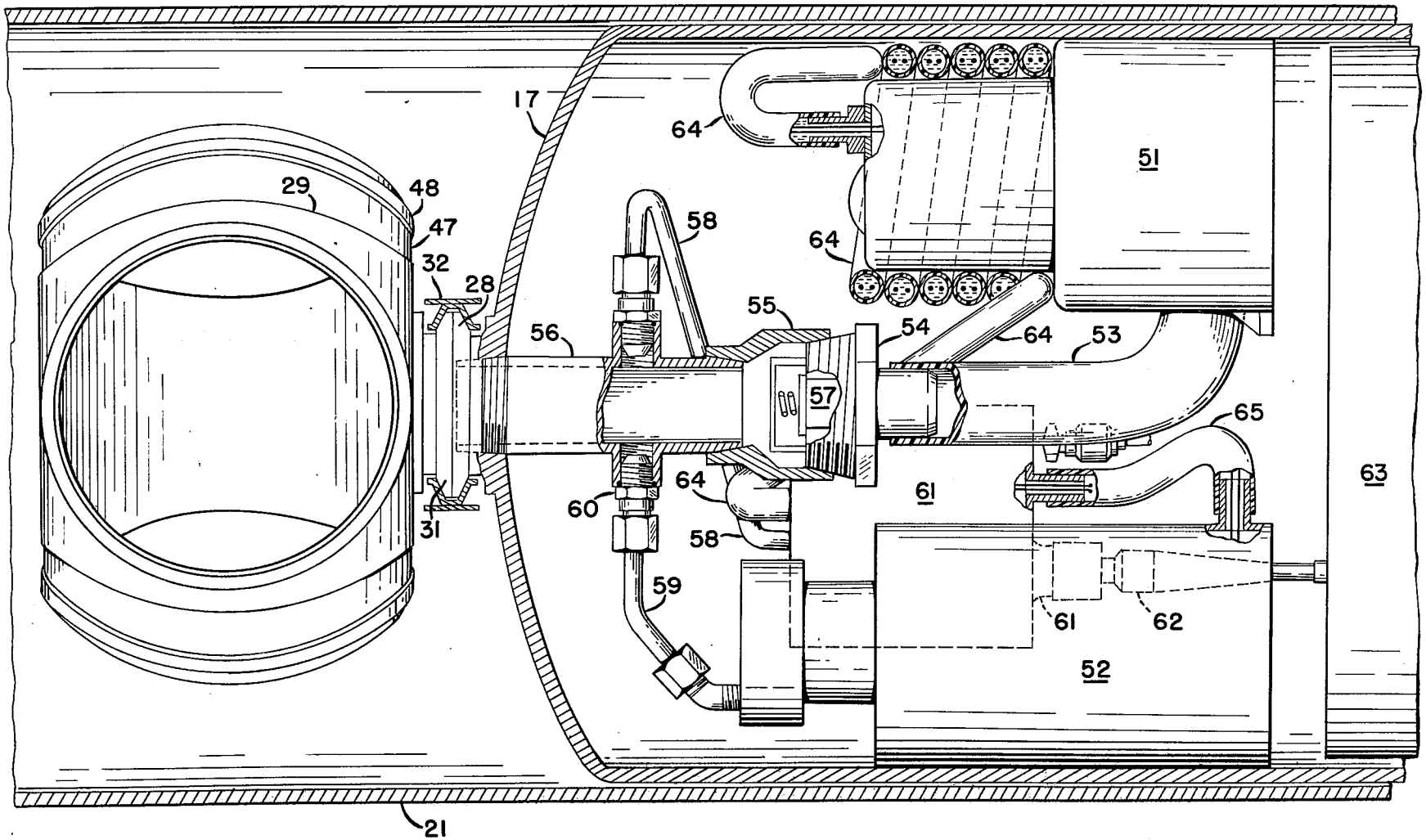
FIG. 7 is a longitudinal sectional view of the pump housing illustrated in FIG. 2.

Referring to FIG. 7, a longitudinal section view is taken through the forward part of housing 17 to reveal the internal arrangement of the parts contained therein. As shown, a low pressure pump 51 and a high pressure pump 52 are located within housing 17, Pump 51 discharges through a discharge pipe 53 which communicates with a fitting 54 which is threadably received into a manifold 55 which, in turn, is connected to plenum chamber 29 via a conduit 56. A check valve 57 is located within manifold 55 and fitting 54 such as to be in fluid communication with conduit 56 and discharge pipe 53. The purpose of check valve 57 is to prevent high pressure transfer of fluid from high pressure pump 52 or on the structural members attached to plenum chamber 29 to low pressure pump 51.

High pressure pump 52 discharges through discharge pipe 59 which, in turn, is connected to conduit 56 by a conventional threaded fitting 60. A pressure sensing conduit 58 is also connected to conduit 56 and transmits the fluid pressure within the conduit 56 to a relay housing 61 where it is used to actuate pressure responsive electrical switches.

Relay housing 61 is connected, via conventional electrical connector 62, to a source of electrical energy 63. The source of electrical energy 63 may comprise, for example, a seawater activated battery or other electrochemical energy source. Relay housing 61 as well as the motor parts of low pressure pump 51 and high pressure pump 52 are oil filled as is conventional in the oceanographic instrument arts. Pressure equalization for these components is provided by encasing the electrical leads within compliant tubing as illustrated at 64 and 65. An improved pressure equalization is provided by making at least one of these conduits longer than necessary to achieve point-to-point wiring such that a maximum area thereof may be exposed to ambient pressure. In the illustrated arrangement, this is accomplished by making conduit 64 spirally wound about the motor portion of low pressure pump 51.

Figure 8:
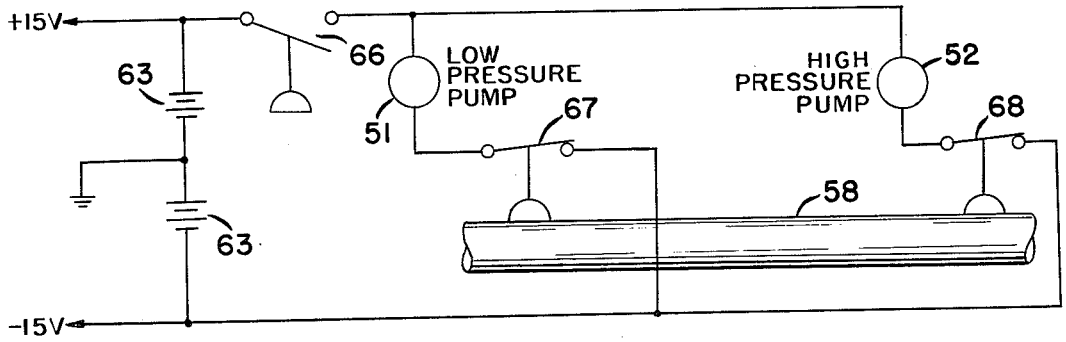
FIG. 8 is a schematic diagram showing electrical interconnections of the pumping system of FIG. 7.

Referring now to FIG. 8, a circuit diagram showing the operation of the pumping control circuitry contained within housing 61 is illustrated. As shown, source of electrical power 63 provides, via internal tapping arrangements, a plus and minus 15 volt power output. This power output is useful and the electronics package 16 as well as transmitter 15. In addition, this battery arrangement provides 30 volts of operating potential for low pressure pump 51 and high pressure pump 52. As shown, a switch 66 energizes low pressure pump 51 and high pressure pump 52 simultaneously. This energization may be accomplished by a time operated mechanism, a fluid pressure operated mechanism, or other suitable delay system to ensure that circuit closure occurs subsequent to the deployment of the array 11 from housing 21. Upon actuation, low pressure pump 51 provides a high volume of fluid from the ambient submarine environment to cause conduits 12, 13, and 14 to be filled and to distend. As the pressure within plenum chamber 29 and conduits 12, 13, and 14 approaches the maximum working pressure of low pressure pump 51, a fluid pressure actuated switch 67 is opened by fluid pressure sensing conduit 58 to interrupt the electrical flow to low pressure pump 51 such that its operation ceases and the pump no longer consumes electrical power. High pressure pump 52, however, continues to operate until a pressure is obtained which causes conduits 12, 13, and 14 to assume the predetermined degree or rigidity. When this pressure is achieved, electrical switch 68 is similarly actuated by conduit 58 and the operation on high pressure pump 52 ceases such that the entire output from the source of electrical energy 63 may be used for other purposes within the oceanographic array 11.

It should be noted, that conduits 12, 13, and 14 are made of a thin synthetic fabric which has been impregnated with a fluid impervious material such that a fluid-tight container is obtained. Housing 17 as well as cylindrical housing 21 may be made of a lightweight, nonferrous metal, or other suitable rigid material. The choice of materials used in the design of oceanographic array 11 is made from the various materials normally used in marine engineering and naval architecture applications for such assemblies and, in instances where the array is not to be recovered, consideration must be given to the environmental impact caused by the deployment of the array and consequently materials chosen which will have a minimum environmental impact or will be destroyed by the corrosive action of a salt water environment.

The foregoing description taken together with the appended claims constitutes a disclosure such as to enable a person skilled in the electronics and marine engineering arts and having the benefit of the teachings contained therein to make and use the invention. Further, the structure herein described meets the aforestated objects of the invention and, generally constitutes a meritorious advance in the art unobvious to such a worker not having the benefit of these teachings.

Obviously, many modifications and variations are possible in the light of the above teachings, and, it is therefore understood the invention may be practiced otherwise than as specifically described.

What is claimed is:

1. A storage and erection system for a submarine structure comprising:

a cylindrical housing;

a removable end portion effectively held to said cylindrical housing to close one end thereof;

a piston slidably fitted within said cylindrical housing and effectively joined to said removable end portion such that movement of said piston causes removal thereof;

actuation means located within said cylindrical housing and positioned such that the piston is intermediate said removable end portion and said actuation means for moving of said piston;

fluid pressure means slidably held within said cylindrical housing and effectively connected to said removable end portion for removal therewith for providing a quantity of fluid under predetermined pressure; and flexible conduit means attached to said fluid pressure means and folded to occupy the space within said cylindrical housing between said fluid pressure means and said piston for receiving said quantity of fluid and dimensioned to achieve structural rigidity when filled with said quantity of water at the predetermined pressure.

2. A storage and erection system according to claim 1 wherein said cylindrical housing includes a mounting means on an external strongback secured to the outer surface thereof.

3. A storage and erection system according to claim 1 wherein said removable and portion is attached to said cylindrical housing via the intermediary of said fluid pressure means.

4. A storage and erection system according to claim 1 wherein said actuation means includes a gas filled cartridge.

5. A storage and erection system according to claim 1 wherein said fluid pressure means include fluid pump means.

6. A storage and erection system according to claim 5 wherein said pump means includes a high pressure pump and a low pressure pump.

7. A storage and erection system according to claim 6 in which said high pressure pump and said low pressure pump are electrically driven pumps.

8. A storage and erection system according to claim 7 in which said high pressure pump and said low pressure pump are fluid filled.

9. A storage and erection system according to claim 8 in which said high pressure and low pressure pumps are pressure compensated by compliant, fluid-filled tubes connected thereto.

10. A storage and erection system according to claim 9 further including electrical power connections within said compliant, fluid-filled tubes.

11. A storage and erection system according to claim 7 further including:

manifold means connecting the aforesaid electrically driven pumps and the aforesaid flexible conduit means for providing fluid coupling there between;

a pressure sampling conduit connected to said manifold means; and fluid actuated switches connected to said pressure sampling conduit for actuation thereby and connected in electrical circuit with the aforesaid electrically driven pumps for control thereof in dependence upon the fluid pressure within said manifold.

12. A storage and erection system according to claim 6 further including a manifold means connected to said high pressure pump and effectively connected to said low pressure pump for receipt of the fluid output therefrom and effectively connected to the aforesaid flexible conduit means for transfer of the fluid output of said high and low pressure pumps to the aforesaid flexible conduit means.

13. A storage and erection system according to claim 12 wherein said low pressure pump is connected to said manifold via a check valve.

* * * * *